United States Patent [19]

Oliff

[11] 4,373,630

[45] Feb. 15, 1983

[54] WRAPAROUND ARTICLE CARRIER WITH ADJUSTABLE GIRTH

[75] Inventor: James R. Oliff, Austell, Ga.

[73] Assignee: The Mead Corporation, Dayton, Ohio

[21] Appl. No.: 342,400

[22] Filed: Jan. 25, 1982

[51] Int. Cl.[3] ..... B65D 71/00; B65D 85/62

[52] U.S. Cl. ..... 206/434; 206/148; 229/40

[58] Field of Search ..... 206/434, 427, 153, 158, 206/152, 154, 157, 156, 147, 148, 149, 429, 173, 16 R; 229/40, 52 BC, 28 BC; 217/3 FC, 3 R, 3 C

[56] References Cited

U.S. PATENT DOCUMENTS

| | | | |
|---|---|---|---|
| 2,786,572 | 3/1957 | Gentry | 206/140 |
| 3,169,691 | 2/1965 | Wood | 229/40 |
| 3,361,331 | 1/1968 | Weiss | 229/40 |
| 3,508,699 | 4/1970 | Graser | 229/40 |
| 3,640,448 | 2/1972 | Wood | 229/40 |

FOREIGN PATENT DOCUMENTS

| | | | |
|---|---|---|---|
| 24782 | 3/1981 | European Pat. Off. | 206/429 |

*Primary Examiner*—Joseph Man-Fu Moy
*Assistant Examiner*—Jimmy G. Foster
*Attorney, Agent, or Firm*—Rodgers & Rodgers

[57] ABSTRACT

For packaging groups of articles whose exterior dimensions may vary somewhat, an article carrier of the wraparound type comprises a blank of generally rectangular configuration having lap panels at its ends which may be overlapped and secured together in flat face contacting relation in alternate relative positions of long and short overlaps to form tubular structures of different girths respectively wherein at least one pair of tightening apertures formed respectively in said lap panels for receiving machine tightening elements operable to impart tightening action to said blank when disposed about a group of articles, said one pair of tightening apertures being spaced a predetermined distance from one longitudinal edge of said blank, and a second pair of tightening apertures formed respectively in said lap panels for receiving machine tightening elements operable to impart tightening action to said blank when disposed about a group of articles, said second pair of tightening apertures being spaced said predetermined distance from the longitudinal edge of said blank which is opposite from said one longitudinal edge thereby to adapt the carrier blank for transverse orientation in different positions relative to the associated group of articles and the spacing between the apertures of each pair of tightening apertures being different in a direction longitudinally of the blank.

5 Claims, 5 Drawing Figures

WRAPAROUND ARTICLE CARRIER WITH ADJUSTABLE GIRTH

TECHNICAL FIELD

This invention relates to article carriers of the wraparound type and is concerned with improved tightening means whereby a particular carrier may be used for groups of articles having dimensions which vary somewhat from one group to another group.

BACKGROUND ART

U.S. Pat. No. 2,786,572 issued Mar. 26, 1957 discloses a wraparound type article carrier wherein tightening apertures are formed in lap panels at the ends of the blank for receiving machine tightening elements operable to move inwardly toward each other so as to tighten the wrapper about an article group. No provision is made in this disclosure for accommodating article groups of different sizes.

DISCLOSURE OF THE INVENTION

In accordance with this invention in one form, an article carrier formed from a blank of the wraparound type is provided in which groups of articles which may vary in size somewhat from group to group may be accommodated and wherein lap panels at the ends of the blank are provided with two sets of tightening apertures respectively and wherein the apertures of one set are spaced from one longitudinal edge of the blank by substantially the same distance as the apertures of the other set of apertures are spaced from the opposite longitudinal edge of the blank to accommodate reversed lateral orientation of the blank, the spacing longitudinally of the blank between the apertures of the two sets of apertures being different so as to accommodate article groups of different sizes.

BEST MODE OF CARRYING OUT THE INVENTION

Figure 1:
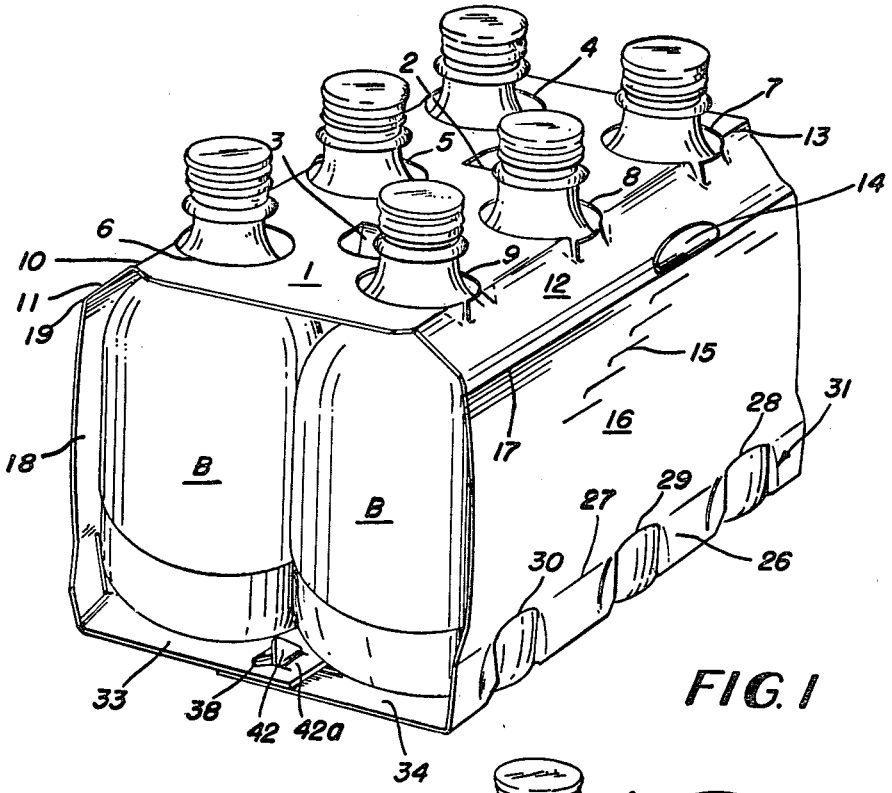
FIG. 1 is a perspective view of a set-up carton of the wrap-around type and which is formed according to this invention.

In the drawings the numeral 1 designates a top panel having finger gripping tabs 2 and 3 struck out of the top panel 1 to define finger receiving openings to facilitate portability of the carrier. Also formed in top panel 1 are a plurality of apertures 4, 5, 6, 7, 8 and 9 which are of known construction and which are for the purpose of receiving the necks of packaged articles as is apparent for example in FIG. 1.

The apertures 4–9 formed in top panel 1 are provided with specially constructed cut and slit lines generally indicated at **4*a* and which are of known construction and form no part of the present invention. Foldably joined along fold line 10 to one edge of top panel 1 is a sloping panel 11 while a similar sloping panel 12 is foldably joined along fold line 13 to the opposite edge of top wall 1. A suitable pull tab 14 is formed in sloping panel 12 and a series of tear slits 15 of known construction are formed in side wall 16 which in turn is foldably joined to the bottom edge of sloping panel 12 along fold line 17**.

On the other side of the carrier a side wall 18 is foldably joined to the bottom edge 19 of sloping panel 11.

Sloping panel 20 is foldably joined to the bottom edge of side wall 18 along fold line 21 and includes a plurality of apertures 22, 23, and 24 which are of known construction and which receive the heels of adjacent bottles. Suitable structure for cushioning the bottles is of known construction and is generally indicated at 25 in connection with aperture 24.

On the opposite side of the carrier a sloping panel 26 is foldably joined along fold line 27 to the bottom edge of side wall 16 and a plurality of apertures 28, 29 and 30 are formed in sloping panel 26 and in the lower portion of side wall 16 and are of conventional construction and include yieldable structure indicated at 31 in connection with aperture 28. Apertures 28–30 receive the heels of the adjacent bottles.

Foldably joined to the lower edge 32 of sloping panel 20 is a bottom lap panel 33 while a bottom lap panel 34 is foldably joined to the lower edge **26*a* of sloping panel 26. As is well known, lap panels 33 and 34** are disposed in overlapped face contacting relation and are secured together to form a secure tubular wrapper which envelopes a group of packaged articles such as bottles "B".

Figure 3:
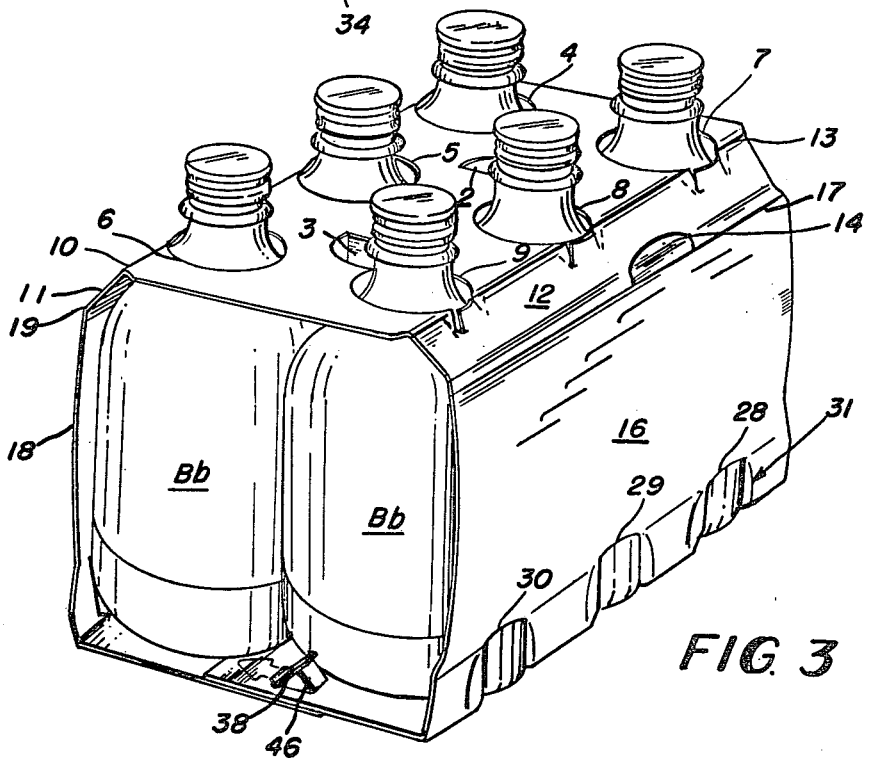
FIG. 3 is a perspective view of the carton shown in FIG. 1 but which shows the bottom lap panels with their relative positions changed from that shown in FIG. 1 to provide a carrier having a different girth from that of the carrier of FIG. 1.
Figure 4:
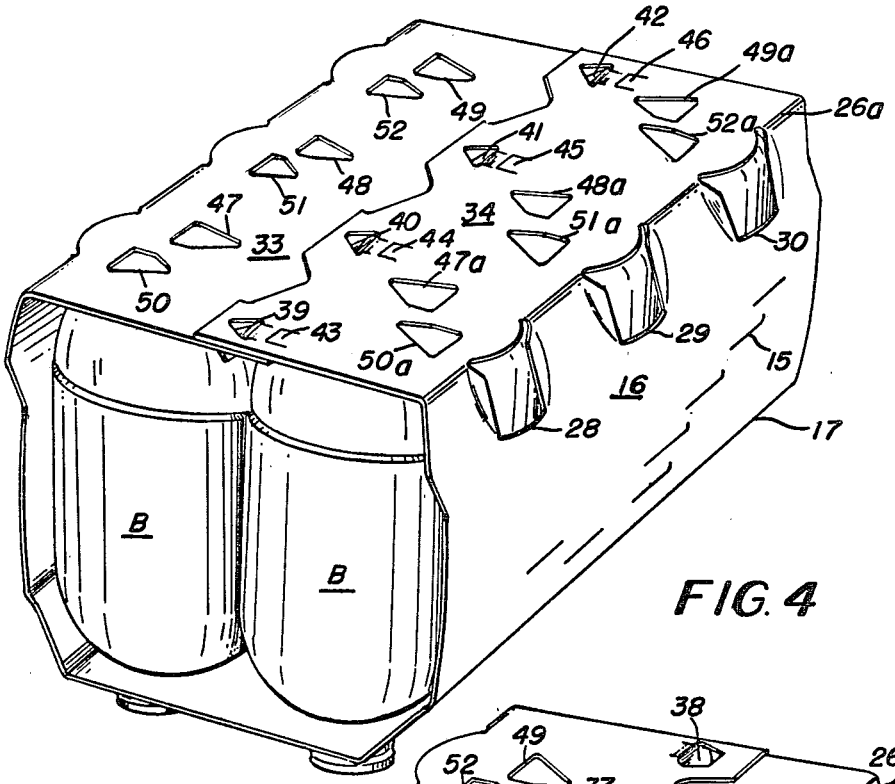
FIG. 4 is a perspective view of the carton shown in FIG. 1 but which is shown in upside down position so as to indicate the inner locking structure formed according to this invention and FIG. 5 is a perspective view of the carton of FIG. 3 shown upside down to show the orientation and cooperation of the interlocking means formed according to this invention and which affords a carton of different girth from that shown in FIGS. 1 and 4.
Figure 5:
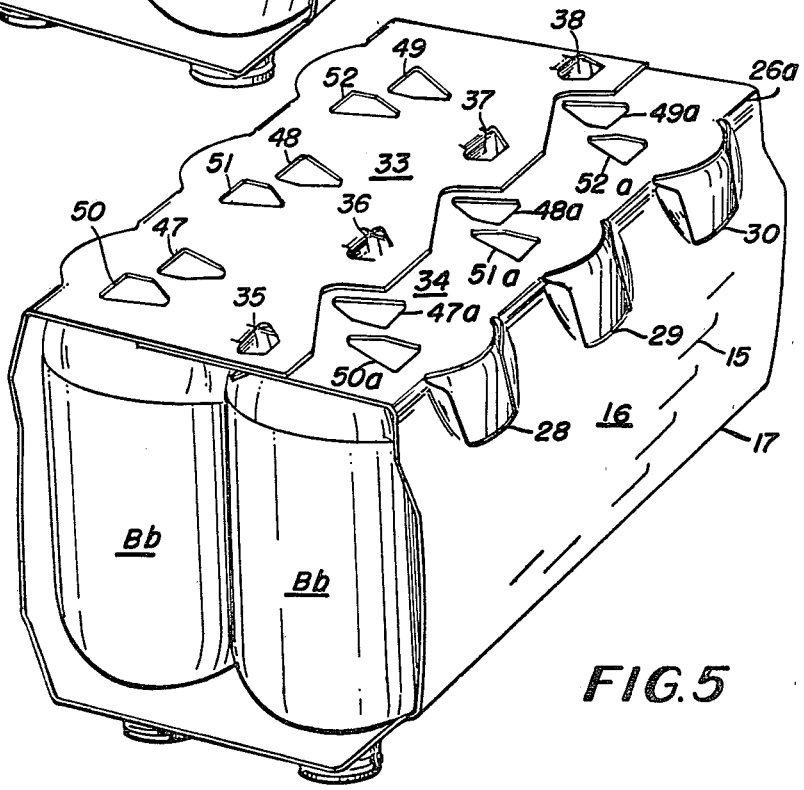

The articles shown in FIGS. 1 and 4 include a cup shaped bottom portion and are generally slightly larger than the bottles Bb shown in FIGS. 3 and 5. Thus according to this invention in one form, bottles of both sizes are packaged securely in a single wrapper formed according to this invention.

With reference to lap panel 33, it is apparent that combination locking and retaining tabs 35–38 are struck from lap panel 33. These combination locking and retaining tabs define locking edges **35*a*, 36*a*, 37*a* and 38*a* respectively. With panel 33 disposed above lap panel 34 as shown in FIG. 1, locking tabs 39–42 in lap panel 34 respectively may be driven through the apertures defined by combination locking and retaining tabs 35–38 respectively. When so arranged, combination locking and retaining tabs 35–38 function as retaining tabs and serve to prop the associated locking tabs such as 39–42 respectively in secure and locked position as shown in FIG. 1 with the base portion 42*a* of locking tab 42 disposed in secure engagement with the locking edge 38*a* of combination locking and retaining tab 38 and the girth of the wrapper extends longitudinally along the blank from base 42*a* of locking edge 38*a*. Of course the locking tabs 39–41 are similarly oriented with respect to the openings defined by combination retaining and locking tabs 35–37 respectively and their associated locking edges 35*a*–37*a* respectively. With the wrapper secured as described and as shown in FIGS. 1 and 4**, bottles of a certain size are securely accommodated.

In order to accommodate bottles somewhat smaller than the bottles shown in FIGS. 1 and 4 and such as are shown in FIGS. 3 and 5, the wrapper is manipulated so that lap panel 34 is disposed above and in face contacting relationship with lap panel 33 as shown in FIG. 3. When so arranged, combination locking and retaining tabs 35–38 are driven through the apertures defined by retaining tabs 43–46 respectively which are formed in lap panel 34. Tabs 35–38 function as locking tabs and the retaining tabs 43–46 respectively function normally as retaining tabs and the base portions **35*b*–38*b* are disposed in abutting contact with locking edges 43*a*–46*a* respectively and the space between these parts is the girth dimension of the wrapper. The result is a carrier as shown in FIGS. 3 and 5 which is of a smaller girth than the carrier shown in FIGS. 1 and 4 and which therefore securely accommodates bottles Bb which are somewhat smaller than the bottles B shown in FIGS. 1 and 4**.

The arrangement for locking the lap panels together as described above is disclosed and claimed in U.S. patent application Ser. No. 337,777 filed Jan. 7, 1982.

In order properly to tighten the wrapper about the groups of articles, tightening apertures are provided in lap panels 33 and 34 and are designated 47–49 in lap panel 33 and are designated **47*a*–49*a* in lap panel 34. Suitable machine tightening elements enter these tightening apertures and tighten the package for the larger group of articles as shown for example in FIGS. 1 and 4** prior to locking these lap panels together.

In like fashion tightening apertures 50–52 are formed in lap panel 33 and cooperate with tightening apertures **50*a*–52*a* formed in lap panel 34 so as to aid in forming a package such as that shown in FIGS. 3 and 5**.

Figure 2:
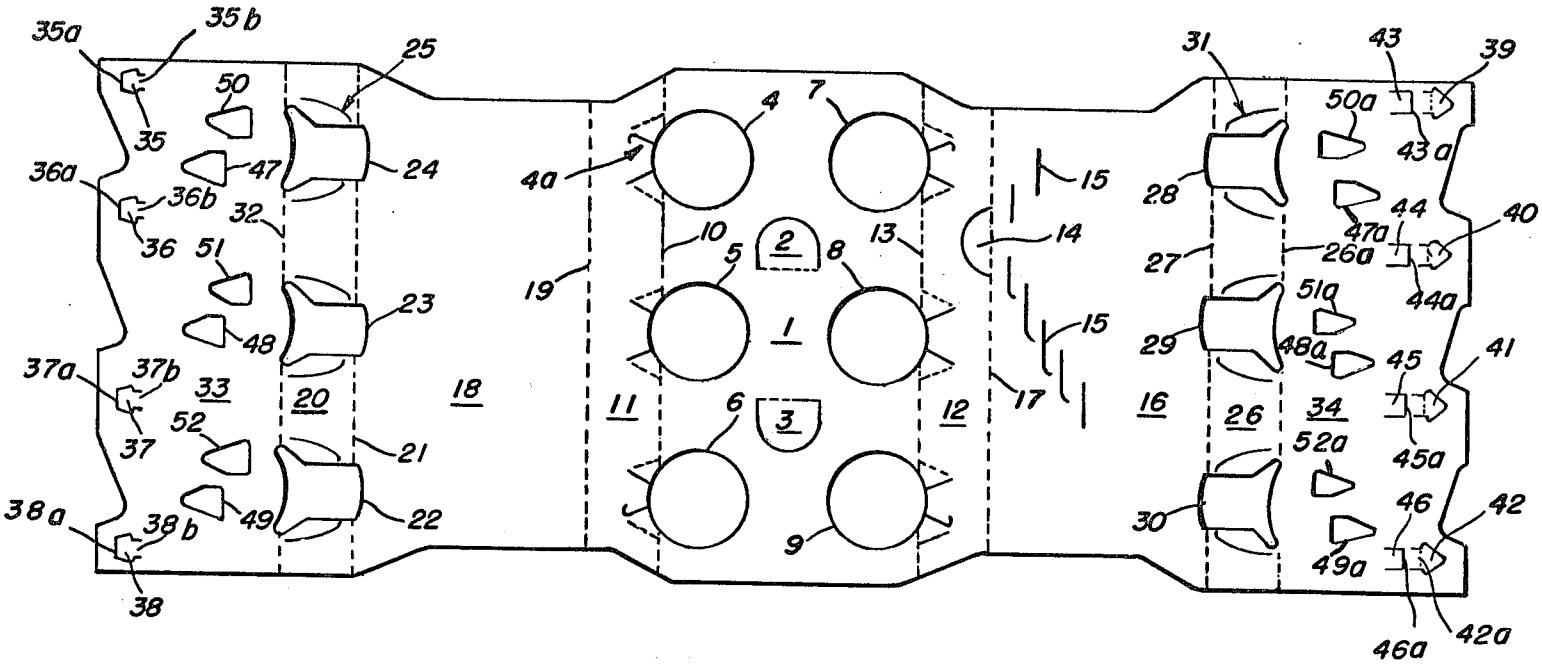
FIG. 2 is a plan view of a blank as viewed from its outside surface and which is used to form the package of FIG. 1.

As is apparent from FIG. 2, the tightening apertures 47–49 and **47*a*–49*a* are spaced from one longitudinal edge of the blank such as the upper edge by a distance which is equal to the spacing of corresponding apertures 50–52 and 50*a*–52*a*** from the opposite longitudinal edge of the blank such as the lower edge. Because of this and in accordance with one feature of the invention it is possible to reorient the blank in the machine hopper by simply rotating the blank 180° about a vertical axis. This procedure may be effected without requiring any machine adjustment since the timing chains which engage the trailing longitudinal edge of the blank do not change the position of the blank relative to the tansversely movable tightening machine elements.

As is obvious the spacing longitudinally of the blank between tightening apertures 47–49 and **47*a*–49*a* is different from the spacing longitudinally of the blank between tightening apertures 50–52 and 50*a*–52*a*. This difference in spacing is the device by which article groups of different sizes from group to group may be accommodated by the same wrapper such as that shown in FIG. 2** and without requiring any adjustment to the feeding or tightening apparatus of the packaging machine. The only requirement in changing from one article size to another is simply that the blank be rotated 180° about its vertical center line.

INDUSTRIAL APPLICABILITY

This invention is particularly well suited for use in conjunction with packaging of groups of articles which are similar to but slightly different in size and to which the invention is also applicable without requiring adjustment of machine elements or of machine timing of such elements and thus provides a substantial degree of adaptability whereby packaging efficiency is substantially enhanced in connection with the use of article carriers of the wraparound type.

I claim:

1. In an article carrier of the wraparound type formed from a blank of generally rectangular configuration and having lap panels at its outer ends which are overlapped and secured together in flat face contacting relation in alternate relative positions of long and short overlaps to form tubular structures of different girths respectively, an improved tightening means comprising at least one pair of tightening apertures formed respectively in said lap panels for receiving machine tightening elements operable to impart tightening action to said blank when disposed about a group of articles, said one pair of tightening apertures being spaced a predetermined distance from one longitudinal edge of said blank, and a second pair of tightening apertures formed respectively in said lap panels for receiving machine tightening elements operable to impart tightening action to said blank when disposed about a group of articles, said second pair of tightening apertures being spaced said predetermined distance from the longitudinal edge of said blank which is opposite from said one longitudinal edge thereby to adapt the carrier blank for transverse orientation in different positions relative to the associated group of articles by rotating the blank when disposed in a horizontal plane through an angle of 180° about a vertical axis, said second pair of tightening apertures being spaced from each other in a direction longitudinally of the blank by a distance which is different than the spacing between said one pair of tightening apertures in a direction longitudinally of the blank thereby to adapt the carrier for packaging article groups comprising articles of different sizes, said pairs of apertures being arranged in staggered relationship with respect to each other.

2. An article carrier according to claim 1 wherein a plurality of pairs of tightening apertures are formed in said lap panels respectively and wherein said pairs of tightening apertures are disposed at different predetermind distances from one longitudinal edge of the blank and wherein a corresponding plurality of pairs of tightening apertures are formed in said lap panels respectively and wherein said corresponding plurality of pairs of tightening apertures formed in said lap panels respectively are disposed at different corresponding predetermined distances from the opposite longitudinal edge of the blank respectively, corresponding tightening apertures of said plurality of pairs of apertures and of said corresponding plurality of pairs of apertures being spaced substantially the same distances respectively from opposite longitudinal edges of the blank.

3. An article carrier according to claim 2 wherein each pair of apertures of said plurality of pairs of apertures are spaced from each other by substantially the same distance in a direction longitudinally of the blank.

4. An article carrier according to claim 2 wherein each pair of apertures of said corresponding plurality of apertures are spaced from each other by substantially the same distance in a direction longitudinally of the blank.

5. In an article carrier of the wraparound type formed from a blank of generally rectangular configuration and having lap panels at its outer ends which are overlapped and secured together in flat face contacting relation in alternate relative positions of long and short overlaps to form tubular structures of different girths respectively, an improved tightening means comprising a plurality of pairs of tightening apertures formed in said lap panels respectively, said pairs of tightening apertures being disposed at different predetermined distances from one longitudinal edge of the blank and a corresponding plurality of pairs of tightening apertures being formed in said lap panels respectively and said corresponding plurality of pairs of tightening apertures formed in said lap panels respectively being disposed at different corresponding predetermind distances from the opposite longitudinal edge of the blank respectively, corresponding tightening apertures of said plurality of pairs of apertures and of said corresponding plurality of pairs of apertures being spaced substantially the same distances respectively from opposite longitudinal edges of the blank, said apertures of said plurality of pairs of apertures and of said corresponding plurality of pairs of apertures being arranged in staggered relationship with respect to each other.

* * * * *